United States Patent [19]

Dammann

[11] 4,251,472

[45] Feb. 17, 1981

[54] CARBURETOR FOR COMBUSTION ENGINES

[75] Inventor: Martin Dammann, Herten B. Roermond, Fed. Rep. of Germany

[73] Assignee: Pierburg GmbH & Co. KG, Neuss, Fed. Rep. of Germany

[21] Appl. No.: 38,308

[22] Filed: May 11, 1979

[30] Foreign Application Priority Data

Jul. 19, 1978 [DE] Fed. Rep. of Germany ..... 2831605

[51] Int. Cl.[3] ..... F02M 9/06

[52] U.S. Cl. ..... 261/44 C; 261/50 A; 261/65; 261/67; 261/DIG. 74; 123/438; 261/DIG. 39

[58] Field of Search ..... 123/119 EC, 32 EE; 261/50 A, DIG. 74, 67, 65, 44 C, DIG. 39

[56] References Cited

U.S. PATENT DOCUMENTS

| | | | |
|---|---|---|---|
| 1,862,978 | 6/1932 | Norris | 261/50 A |
| 2,009,109 | 7/1935 | Hunt | 261/67 |
| 2,240,497 | 5/1941 | Dunn | 261/50 A |
| 2,828,116 | 3/1958 | Bascle, Jr. | 261/50 A |
| 3,281,132 | 10/1966 | Barnes | 261/50 A |
| 3,906,910 | 9/1975 | Szlaga, Jr. | 123/119 EC |
| 4,084,562 | 4/1978 | Eckert | 123/119 EC |
| 4,088,095 | 5/1978 | Aono | 123/32 EE |
| 4,109,615 | 8/1978 | Asano | 123/119 EC |

*Primary Examiner*—Tim R. Miles

*Attorney, Agent, or Firm*—Haseltine, Lake & Waters

[57] ABSTRACT

A carburetor for combustion engines with a mixing chamber in the carburetor housing, the mixing chamber being bounded downstream by a randomly actuated mixture throttle and upstream by an air throttle controlling the intake air cross section and actuated by the pressure prevailing in the mixing chamber. A bypass air duct discharges into the center of the mixing chamber and receives the fuel supply. A nozzle pin cooperates with the air throttle and controls the cross section of a fuel jet. Downstream of this jet is another fuel jet whose cross section is controllable as a function of engine operating parameters by means of an analog magnet. The fuel jet controlled by the analog magnet may be the fuel outlet in the bypass air duct, and may be controlled by a nozzle pin through a lever via the analog magnet which is a plunger system. The second fuel jet may be located in a bypass air duct and its cross section may also be controlled by an analog magnet as a function of engine operating parameters. The analog magnet may be excited via a regulator with a sinusoidal modulated direct current.

3 Claims, 2 Drawing Figures

CARBURETOR FOR COMBUSTION ENGINES

BACKGROUND OF THE INVENTION

The present invention relates to a carburetor for combustion engines with a mixing chamber located in the carburetor housing. This chamber is bounded downstream by a randomly actuated mixture throttle and upstream by an air throttle which controls the intake air cross section and is actuated by the pressure prevailing in the mixture chamber. A bypass air duct discharges into the center of the mixing chamber and into which the fuel supply discharges. A nozzle pin cooperates with the air throttle and controls the cross section of a fuel jet.

Such a carburetor is disclosed in the German Laid-Open Document No. 25 16 949 as a rotation symmetrical carburetor in which air throttle and throttle flap are pipe-shaped. Even though this carburetor determines the fuel-air ratio, especially in the partial load range as a function of the air mass flow, the present invention has the object to provide an arrangement to comply with the increasing severity of pollution laws and to allow a regulation in a simple manner.

Another object of the present invention is to provide a carburetor of the foregoing character which is substantially simple in construction and may be economically fabricated.

A further object of the present invention is to provide a carburetor, as described, which may be easily maintained in service and which has a substantially long operating life.

SUMMARY OF THE INVENTION

This object of the present invention is achieved by arranging upstream of the fuel jet with controllable cross section another fuel jet controllable as a function of engine operating parameters by varying the cross section by means of an analog magnet. This object is further achieved by providing a fuel jet, controllable as a function of engine operating parameters by varying the cross section by means of an analog magnet, in a bypass duct for the fuel jet whose cross section is variable.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
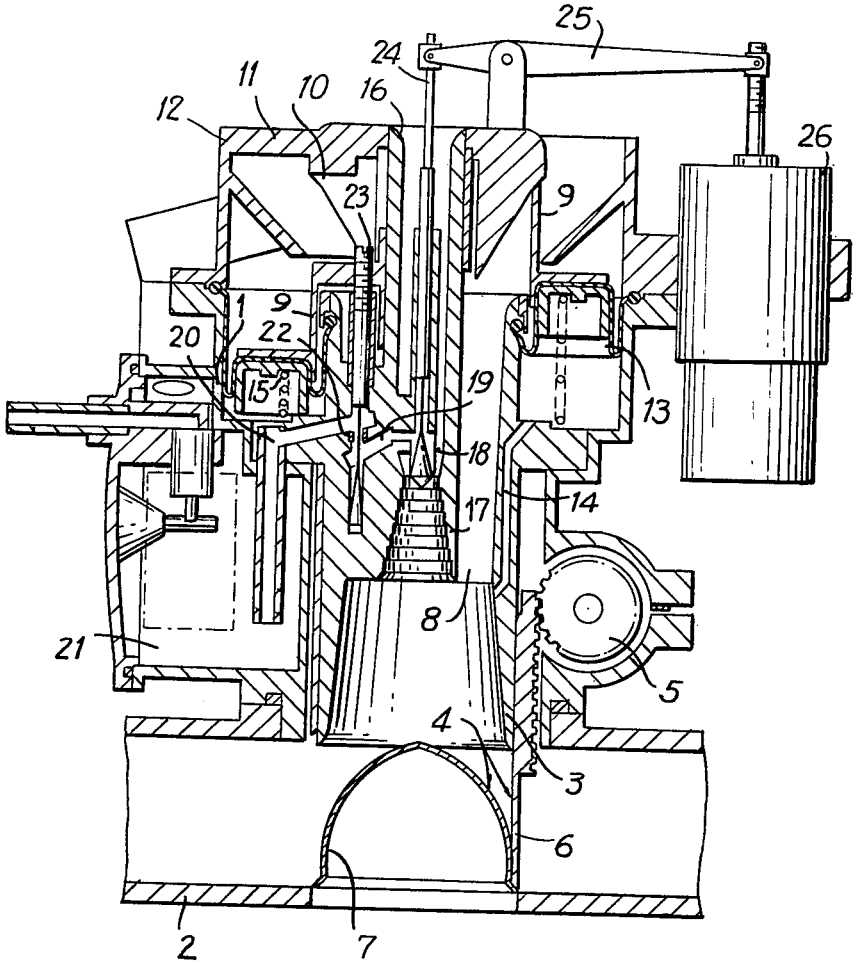
FIG. 1 is a sectional elevational view and shows a carburetor with the fuel jets series-connected.
Figure 2:
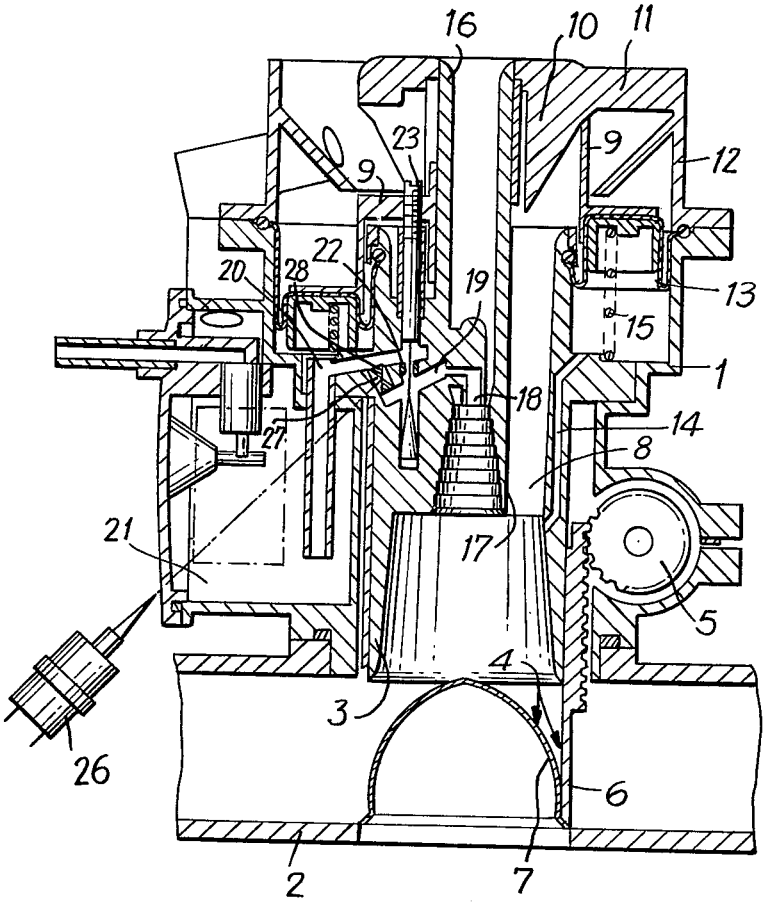
FIG. 2 is a sectional elevational view and shows a carburetor with the fuel jets in parallel connection.

In both FIG. 1 and FIG. 2, the left side illustrates the carburetor in full-speed operation, whereas the right side illustrates idle operation. This should be borne in mind as the detailed descriptions proceeds.

The carburetor housing 1 is fastened to intake pipe 2. Its venturi-shaped mixing chamber 3 is bounded downstream by a randomly actuated mixture throttle 4. This throttle consists of a pipe 6 arranged coaxially and movable along the mixing chamber 3 by a rack-and-pinion drive 5, and a cone 7 arranged in intake pipe 2. Upstream the mixing chamber 3 is bounded by a pipe-shaped air throttle located coaxially and shiftable to the air funnel 8 passing into the mixing chamber 3, and by an air intake cone 10. The air intake cone 10 is a part of the closure member 11 of the carburetor cover 12. A diaphragm 13 is mounted between carburetor housing 1 and carburetor cover 12. This diaphragm encircles the pipe-shaped air throttle 9 and acts against a compression spring 15 via the vacuum taken from the mixing chamber 3 via a duct 14. A bypass air duct is located in the center of the closure member 11. This duct at its lower end is a venturi-shaped pre-diffuser 17 and has the fuel outlet 18 at its narrowest cross section. The fuel is supplied via a duct 10 and a bridge located in air funnel 8 to the exit 18.

The duct 19 is fed via the drill hole 20 by the float chamber 21 via the fuel nozzle 23 whose flow cross section is controlled by a nozzle pin 23 which is connected to air throttle 9.

Since both carburetor embodiments have very similar mechanical design, it is expedient to describe their function jointly. The different design of the control devices and their function will be described later. During idling, the air throttle 9 is completely closed and the air required for the mixture flows through the bypass air duct 16. At the fuel outlet 18, the fuel required for idling mixture is sucked at high air speed and goes to the mixing chamber 3 and, through an idling annular gap remaining between pipe 6 and cone 7, into intake pipe 2. If in the partial load range, pipe 6 is lifted via the rack-and-pinion drive 5, the vacuum pressure in the mixing chamber 3 increases and, via duct 14, acts on the diaphragm such that it overcomes the force of compression spring 15 and moves the air throttle 9. As a result, the main air intake into the air funnel 9 is gradually opened according to the movement of the air throttle 9 in cooperation with the air intake cone 10. The flow cross section of fuel jet 22 is controlled by the movement of the air throttle 9 via the nozzle pin 23, so that more fuel is available at the fuel outlet 18 as the airflow increases.

In the embodiment of FIG. 1, the fuel outlet 18 located downstream of the fuel jet 22 controllable by means of the nozzle pin 23 is also in the form of a fuel jet which is controllable via a nozzle pin 24. The pin 24 is actuated via a linkage 25 by an analog magnet 26. The analog magnet has the form of a plunger system whose control path is proportional to the current exciting the coil. The regulator controlling the analog magnet 26 is not shown in greater detail and is selectively supplied with one or several engine operating parameters by means of known signal receivers. These are, individually or in combination, the exhaust gas composition, the air temperature, the cooling water temperature, the intake pipe vacuum pressure. Jet 22 and pin 23 are adjusted so that the fuel quantity can be more or less reduced by means of magnet 26. During starter operation, the plunger system is fully excited for a short period in order to choke the fuel outlet.

The embodiment of FIG. 2 differs from the one above in that the fuel jet 22 with controllable cross section has in a bypass duct 27 another fuel jet 28 whose cross section is controlled by means of an analog magnet 26 as a function of engine operating parameters. Jet 22 and pin 23 must be adjusted so that always part of the fuel flows through the bypass duct 27 to enrich the mixture.

The above embodiments allow regulation of the carburetor by electronics in a simple manner. To reduce the hysteresis of the plunger system it is useful to use a sinusoidal modulated direct current for excitation.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A carburetor for combustion engines comprising: a carburetor housing; a mixing chamber in said carburetor housing; an air throttle including a tube-and-throttle unit arranged axially parallel to and longitudinally shiftable with respect to a bypass air duct and said mixing chamber upstream of a pre-diffuser; a selectively operable mixture throttle including a tube-and-throttle unit arranged axially parallel to and longitudinally shiftable relative to said mixture chamber; said mixing chamber being bounded downstream by said mixture throttle and upstream by said air throttle; an intake air passage controlled by said air throttle and actuated by pressure prevailing in said mixing chamber; said bypass air duct discharging centrally in said mixing chamber; a conical flow-guiding member concentric to and cooperating with said mixture throttle and being rigidly mounted in said intake air passage; a fuel supply discharging into said bypass air duct; a first nozzle pin cooperating with said air throttle; a first fuel jet having a cross section controlled by said nozzle pin; a second fuel jet downstream of said first fuel jet; an analog magnet; said second fuel jet having a cross section controlled by said analog magnet as a function of engine operating parameters.

2. A carburetor as defined in claim 1 wherein said second fuel jet comprises a fuel outlet in said bypass air duct.

3. A carburetor as defined in claim 2 including a second nozzle pin and a lever, said second fuel jet being controlled by said second nozzle pin via said analog magnet, said analog magnet comprising a plunger system.

* * * * *